US005619022A

United States Patent [19]

Long

[11] Patent Number: 5,619,022

[45] Date of Patent: Apr. 8, 1997

[54] PNEUMATIC SNAP ACTION SWITCH

[75] Inventor: Eric Long, Coral Springs, Fla.

[73] Assignee: Micro Pneumatic Logic, Inc., Fort Laurderdale, Fla.

[21] Appl. No.: 493,395

[22] Filed: Jun. 21, 1995

[51] Int. Cl.[6] ..... H01H 35/34

[52] U.S. Cl. ..... 200/83 P; 200/83 N; 200/83 A

[58] Field of Search ..... 200/81 R, 83 R–83 D, 200/83 J, 83 N, 83 P, 83 Q, 83 V, 83 Y

[56] References Cited

U.S. PATENT DOCUMENTS

| | | | |
|---|---|---|---|
| 3,689,719 | 9/1972 | Phillips et al. | 200/83 P |
| 3,793,495 | 2/1974 | Heap | 200/83 B |
| 4,620,073 | 10/1986 | Yokota et al. | 200/83 P |
| 5,177,579 | 1/1993 | Jerman | 73/724 |
| 5,338,908 | 8/1994 | Rahman et al. | 200/83 P |

*Primary Examiner*—Michael L. Gellner
*Assistant Examiner*—Michael A. Friedhofer
*Attorney, Agent, or Firm*—Jay H. Maioli

[57] ABSTRACT

A miniaturized pneumatic snap action switch includes a glass or metallized ceramic body that has a convoluted metal diaphragm closing the open end with a glass to metal seal. The interior of the switch is provided at a desired pressure by a sealable tubulation port and the switch actuation members include a C-spring and a Belleville spring or washer sealed inside the switch housing. The switchable electrical path is from the metal diaphragm, through the C-spring and Belleville spring, to a centrally arranged conductive termination pin embedded in the closed end of the body. The combination of the C-spring and Belleville spring provide the snap action, and the C-spring has two hemispherical engagement portions that centralize the forces through the center line of the switch. The switch is intended for miniature applications and the switch body is less than 0.75 inches in diameter.

16 Claims, 3 Drawing Sheets

PNEUMATIC SNAP ACTION SWITCH

BACKGROUND OF THE INVENTION

1. Field of the Invention

The present invention relates generally to a pressure actuated switch and, more specifically, to a miniaturized pressure actuated switch operating as a pneumatic snap action switch, which is hermetically sealed, and which can be less than one inch in diameter.

2. Description of the Background

Pneumatic snap action switches have been provided for various applications. Such switches are known to have a diaphragm and two or more electrical contacts arranged inside the switch body and sealed by the diaphragm so that upon a particular pressure being applied the internal contacts close and the switch performs its desired function.

Recently, the application has arisen for an extremely miniaturized pneumatic snap action switch that must exist in a relatively hostile environment and that must be hermetically sealed. The current examples of such a miniaturized snap action switch have numerous drawbacks and have generally been found unacceptable. For example, the hermetic seal has proven difficult to maintain when the switch body is made extremely small. The pneumatic snap action switches must be capable of being sealed with a pressure or vacuum present inside the switch to provide the proper actuation and the sealing feature is important.

Heretofore, none of the previously proposed switches have been suitable.

OBJECT AND SUMMARY OF THE INVENTION

Accordingly, it is an object of the present invention to provide a pneumatic snap action switch that overcomes the defects inherent in previously proposed switches of this kind.

It is another object of the present invention to provide a pneumatic snap action switch that is miniaturized so as to be less than one inch in diameter and that can be hermetically sealed and that can function in a hostile environment.

According to an aspect of the present invention, a miniaturized pneumatic snap action switch is provided with an internally arranged mechanism that can be hermetically sealed and used as an absolute pressure switch or open to the atmosphere and operating as a gauge switch when properly housed for different gauge operations. By forming the switch body of metallized ceramic, it is possible to provide a glass-to-metal seal between diaphragm and switch body, thereby providing an hermetically sealed switch.

According to another aspect of the present invention, snap action is provided by the combination of a C-spring and a Belleville spring, and the C-spring is provided with hemispherical engagement portions to centralize the forces through the center line of the switch.

The above and other objects, features, and advantages of the present invention will become apparent from the following detailed description of illustrative embodiments thereof to be read in conjunction with the accompanying drawings.

DETAILED DESCRIPTION OF PREFERRED EMBODIMENTS

Figure 1:
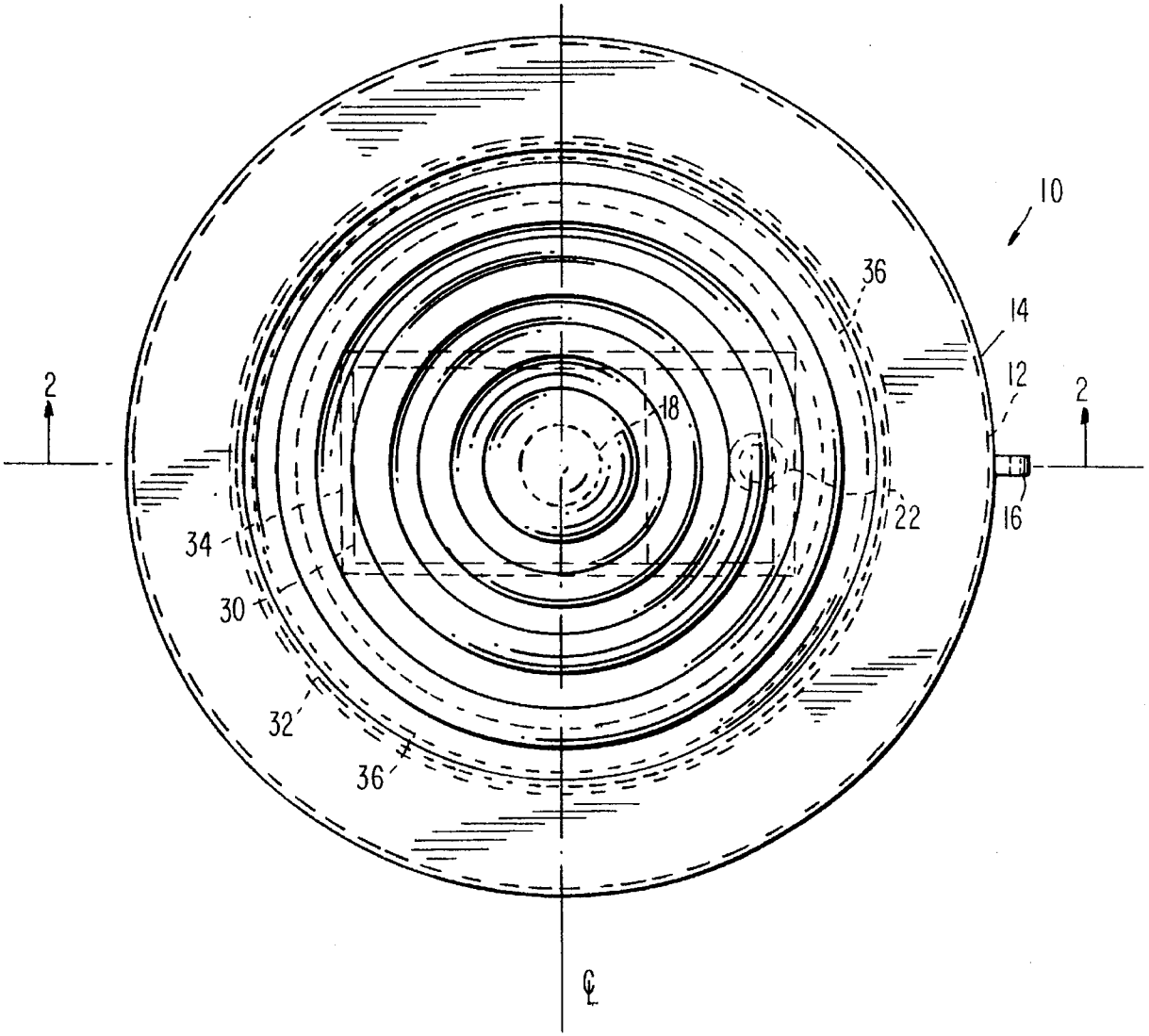
FIG. 1 is a top, plan view of a switch according to an embodiment of the present invention.
Figure 2:
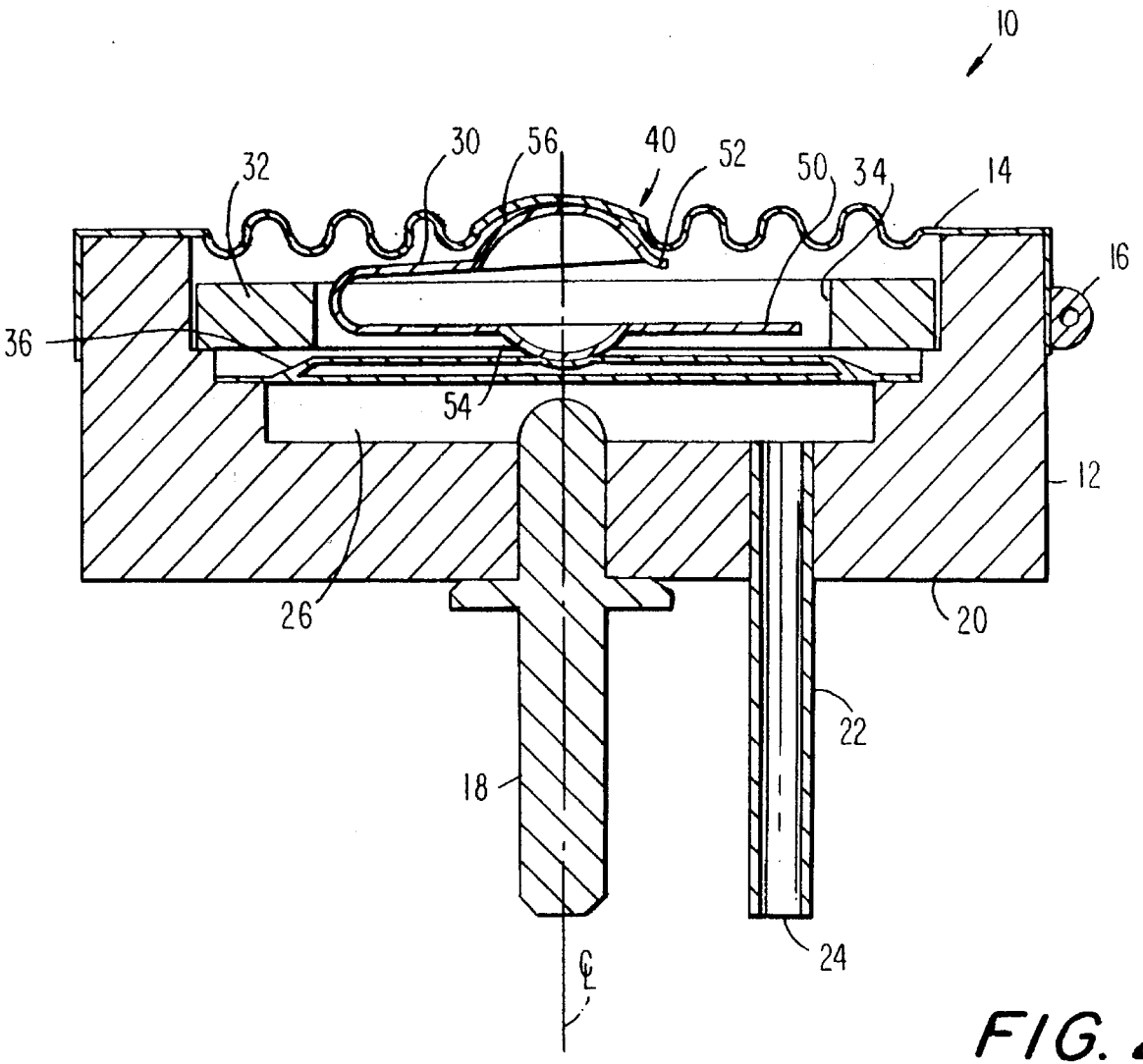
FIG. 2 is a side elevational view in cross section taken along section lines 2—2 of the switch of FIG. 1.

FIGS. 1 and 2 show all of the features of the preferred embodiment of the present invention and, specifically, it is seen that the overall shape of the pneumatic snap action switch 10 is a short cylinder. Because this embodiment is intended for use in a miniaturized system that may be so small as to be mounted on a printed circuit board located on the tire valve stem inside a pneumatic automobile tire for providing an indication of the tire pressure by way of a radio signal from that printed circuit board to a receiver at the dashboard of the automobile, the cylinder representing this embodiment the present invention may be less than three quarters of an inch in diameter. Moreover, the switch 10 need not be cylindrical at all and could also be rectangular.

This embodiment includes a body or housing 12 that is formed of a metallized ceramic or, alternatively, may be formed of glass. The housing 12 is sealingly attached to a diaphragm 14 that may be formed of beryllium copper. The diaphragm 14 has a number of convolutions and is in the generally conventional form for such diaphragms, although much smaller in size. This convoluted diaphragm 14 also forms one of the contacts of the switch, which contact is represented by the electrical lug 16 formed on an outer surface of the switch 10. Thus, one wire (not shown) of the circuit to be switched would be connected to lug 16. It should be understood that lug 16 is shown by way of example only and any alternative approach to making an electrical connection with the metal diaphragm 14 may be adopted.

The other electrical connection for the switch is a termination pin 18 that is inserted through a closed end 20 of the housing 12 and that is bonded or sealed to the housing end 20 by means of a glass-to-metal seal. Because of the operating characteristics of a pneumatic snap action switch, the interior of the switch must be either pressurized or a vacuum pulled, and this is accomplished by means of a tubulation port 22 that extends into the interior of the housing 12. The tubulation port 22 is shown prior to the pressurizing or vacuum operation. More specifically, the tubulation port 22 is initially open at an exterior end 24, however, after the assembly of the switch and the pressurization or the vacuum operation takes place, end 24 will be pinched shut and the interior 26 of the switch will be sealed. Thus, by reason of the glass or metallized ceramic closed end 20, the glass-to-metal seal between the diaphragm 14 and the outer surface of the housing 12, the glass-to-metal seal between the termination pin 18 and closed end 20 of the housing body 12, and the tubulation port 22 inserted into closed end 20 of the housing body with a glass-to-metal seal, with the ultimate pinching off of the end 24 of the tubulation port 22, the interior volume 26 of the pneumatic snap action switch 10 will be hermetically sealed from the exterior of the switch.

Hermetically sealed inside this interior 26 of the switch body 12 is a C-spring 30, a guide washer 32 that has formed therein a slot 34 in which the C-spring 30 resides, and a circular Belleville spring 36 that is preferably formed of stainless steel. The Belleville spring 36 is sometimes referred to as a Belleville washer. The guide washer 32 is a flat metal disc having a rectangular-shaped opening 34 for receiving the C-spring 30. The C-spring 30 provides a measure of hysteresis to the operation of the switch 10, so that it does not continuously cycle on and off in the vicinity of its actuation pressure. The Belleville spring 36 is formed in the well-known fashion and is arranged to have the center portion thereof contacting one arm of the C-spring 30.

Figure 3:
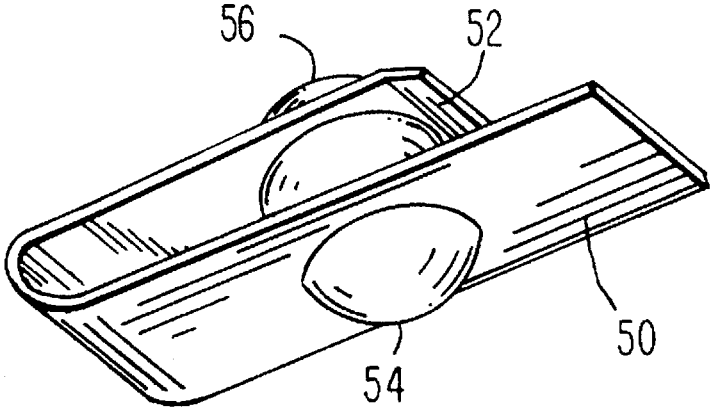
FIG. 3 is a perspective view of the C-spring used in the embodiment of the present invention.

The C-spring 30 is shown in more detail in FIG. 3, in which it is seen that the C-spring 30 consists of a flat spring element bent into a C-shape or a U-shape so as to have two arms 50 and 52. On each arm 50, 52 of the spring element is formed an engagement portion 54, 56, respectively. Each engagement portion 54, 56 is formed as a curved element with a spherical radius. Engagement portion 56 engages the inner surface of the convoluted diaphragm 14 and engagement portion 54 engages the upper surface of the Belleville spring 36. By providing the engagement portions 54, 56 to have spherical radiuses all the forces will be centralized through the center line of the switch.

In the operation of the switch 10, pressure on the entire exterior surface 40 of the corrugated diaphragm 14 causes the C-spring 30 to be deformed and to apply pressure to the Belleville spring 36 so as to and make contact with the contact terminal 18. Thus, an electrical conductivity path is formed between contact 16 and contact 18 thereby closing the switch. Such operation, of course, taking place only after the inside interior 26 of the switch has been either pressurized or reduced in pressure by means of the tubulation port 24 that is subsequently sealed. Of course, the reverse operation takes place as well, so that upon the pressure on surface 40 being reduced the switch opens and the electrically conductive path is opened.

More specifically, when forces are applied to the convoluted diaphragm 14 via atmospheric pressure changes, the force exerted on the convoluted diaphragm 14 is transferred to the C-spring 30, which in turn exerts a force onto the Belleville washer 36. As the C-spring 30 compresses and stores energy, the Belleville washer 36 is an arch resisting the force of the C-spring 30. At a point during the travel of these elements, the arch collapses due to the combined force components becoming a near straight line across the horizontal. The stored energy in the C-spring 30, which is now of an order approximately two times greater than the resistance of the Belleville washer 36 (just prior to the Belleville washer 36 collapsing), continues to follow through, thereby making electrical contact between the Belleville washer 36, the connector pin 18, and the diaphragm 14 and creating a current path. If it were not for the stored energy in the C-spring 30, the convoluted diaphragm 14 by itself would merely stop with no follow through, there would be no stored energy, and the switch would not be a snap action switch.

This embodiment of the inventive switch is particularly suited for a miniaturized tire pressure indicator arranged inside the tire of an automobile and operating in conjunction with a small radio transmitter to transmit information concerning the tire pressure to a receiver at the dashboard of the automobile or truck. Nevertheless, the present invention has numerous other applications and the switch of the present invention is not limited to a tire pressure monitoring application.

Furthermore, if the present invention were to be used as a leaf spring only, with no snap action, the C-spring is simply removed and the forces on the convoluted diaphragm are transferred directly to the Belleville spring.

The above is presented by way of example only and is not intended to limit such illustrative embodiment alone, and various modifications may be contrived without departing from the spirit or essential characteristics thereof, which are to be determined solely from the appended claims.

What is claimed is:

1. A pneumatic switch, comprising a switch body formed of metallized ceramic and having a side wall, an open end, a closed end, and an open interior;

an electrical contact terminal sealingly passing through said closed end and extending from an exterior of said switch body into said interior;

a metal diaphragm arranged over said open end of said body in sealing contact with said side wall and including an electrical contact portion;

metal spring means arranged in said interior between one end of said electrical contract terminal and an inside surface of said diaphragm for performing a snap-action operation upon application of a predetermined force; and tubular means sealingly formed in said switch body for providing fluid communication between said exterior and said interior in a first state and for sealing off said interior from said exterior in a second state, whereby upon a pressure difference existing between said interior and said exterior of said switch body when said tubular means is in said second state, said diaphragm is deformed and exerts said predetermined force to cause said spring means to perform said snap-action operation and contact both said diaphragm and said electrical contact terminal, thereby making electrical continuity between said electrical contact portion of said diaphragm and said electrical contact terminal.

2. The pneumatic switch according to claim 1, wherein said spring means comprises a C-spring arranged in contact with a Belleville spring.

3. The pneumatic switch according to claim 2, wherein said C-spring includes curved engagement portions each having a spherical radius.

4. The pneumatic switch according to claim 2, further comprising a guide washer arranged in said interior of said switch body and having a central slot with said C-spring located in said slot.

5. The pneumatic switch of claim 1, wherein a surface of said diaphragm covering said open end of said body is formed with convolutions.

6. The pneumatic switch of claim 5, wherein said diaphragm is formed of beryllium copper.

7. The pneumatic switch of claim 1, wherein said switch body is cylindrical and said electrical contact terminal is located at the center of the closed end of the cylindrical switch body.

8. The pneumatic switch of claim 1, wherein said electrical contact portion is formed as a lug extending from an exterior surface of said diaphragm.

9. A pneumatic snap action switch comprising:

a non-metallic housing being hollow and having a closed-end;

a metallic diaphragm arranged over an open end of said housing so as to be hermetically sealed with said non-metallic housing and having an electrical terminal portion;

an elongate electrical terminal extending from an exterior of said housing through said closed end into an interior of said hollow, closed-end housing and being in sealing contact with said closed end;

metal spring means located in said interior and arranged between an inner surface of said diaphragm and an end of said elongate electrical terminal in said interior of said housing for performing a snap-action operation upon application of a predetermined force; and mean for placing said interior in fluid communication with said exterior in an open state and for preventing fluid communication between said interior and said exterior in a sealed state, whereby when said interior is placed at a different pressure than a pressure at an exterior surface of said diaphragm, said diaphragm deflects and exerts said predetermined force to cause said metal spring means to perform said snap action operation and alters an electrical continuity from said electrical terminal portion through said metal spring means to said elongate electrical terminal.

10. The pneumatic snap action switch according to claim 9, wherein said non-metallic housing is formed of metallized ceramic.

11. The pneumatic snap action switch according to claim 9, wherein said non-metallic housing is formed of glass.

12. The pneumatic snap-action switch according to claim 9, wherein said spring means comprises a C-spring formed of a flat metal strip in contact with a metal Belleville spring.

13. The pneumatic switch according to claim 12, wherein said C-spring includes curved engagement portions each having a spherical radius.

14. The pneumatic snap-action switch according to claim 12, further comprising a guide washer located in said interior of said housing and having a centrally arranged slot wherein said C-spring is arranged.

15. The pneumatic snap-action switch according to claim 14, wherein said electrical terminal portion is in the form of a lug in electrical contact with and extending from an exterior surface of said diaphragm.

16. The pneumatic snap-action switch according to claim 15, wherein said diaphragm is formed with a plurality of concentric convolutions.

* * * * *